United States Patent [19]

Lecrone

[11] 4,048,883

[45] Sept. 20, 1977

[54] BAND-TYPE ROLL SLICING MACHINE

[76] Inventor: Dale S. Lecrone, 4447 Bonnymede, Jackson, Mich. 49201

[21] Appl. No.: 723,918

[22] Filed: Sept. 16, 1976

[51] Int. Cl.[2] ..... B26D 3/28

[52] U.S. Cl. ..... 83/4; 83/422; 83/813

[58] Field of Search ..... 83/4, 422, 813, 788

[56] References Cited

U.S. PATENT DOCUMENTS

| | | | |
|---|---|---|---|
| 919,556 | 4/1909 | Dittbenner | 83/4 |
| 1,344,096 | 6/1920 | Sprague | 83/4 |
| 2,155,730 | 4/1939 | Miller | 83/422 X |
| 3,340,916 | 9/1967 | Burch | 83/4 X |

FOREIGN PATENT DOCUMENTS

| | | | |
|---|---|---|---|
| 247,314 | 10/1963 | Australia | 83/804 |
| 302,298 | 12/1917 | Germany | 83/808 |

*Primary Examiner*—J. M. Meister
*Attorney, Agent, or Firm*—C. Hercus Just

[57] ABSTRACT

A band type roll slicer comprising a conveyor to feed rolls along a path to an endless band type knife having one section supported above said conveyor and parallel thereto, power means to drive said knife to move said section continuously between opposite sides of said conveyor, and a yieldable pressure unit mounted above said section of said knife and engageable with the upper surfaces of rolls upon said conveyor to apply limited pressure thereto while being sliced by said knife entirely through said rolls in parallelism with the bottom surfaces thereof so that the top and bottom sections of the rolls when completely sliced therebetween will be superimposed in vertical registry and the bottom sections will be of uniform thickness throughout the entire area thereof.

16 Claims, 7 Drawing Figures

BAND-TYPE ROLL SLICING MACHINE

BACKGROUND OF THE INVENTION

During the past 25 years or so, bakeries have introduced as standard products hamburg and hot dog or frankfurter rolls which are sliced between the upper and lower portions thereof for a substantial part of the total area of the rolls but leaving a so-called hinge portion along one edge by which the upper and lower portions of the sliced rolls still are connected. In particular, this facilitates packaging the rolls and, in addition, also facilitates the handling of the rolls when introducing hamburgs and hot dogs or frankfurters respectively to the different types of rolls which are shaped respectively for such contents. More recently, however, a very substantial number of chains of restaurants and quick service establishments have popularized hamburgers of various kinds with numerous types of dressing, as well as multiple layers thereof and these products are advertised under various fanciful names by the respective chains of outlet dispensers. Particularly when multiple layers of hamburgers and the like are disposed between top and bottom portions of hamburg rolls and especially those which are circular in configuration, it is essential that the rolls be sliced entirely through the complete area of the rolls. However, to facilitate packaging and handling of such sliced rolls, the top and bottom portions must be maintained in contiguous relationship, especially while being sliced.

The tremendous volume of rolls of this type which are consumed by the public at present necessitates the slicing of such rolls by machine rather than by manual means and one condition which is insisted upon by the chains of restaurants and other food dispensing establishments which purchase said rolls from bakeries and dispense the same to the public is that the bottom portion or section of each roll must be of uniform thickness throughout, particularly to facilitate the formation of a complete product which comprises the placing of one or more hamburgers, slices of cheese, dressings of various kinds, lettuce and the like in the completed product, all of which is built up upon the foundation of the bottom section of the roll.

At present, it is common practice to slice rolls of the type referred to above by so called band type knife slicers in which an endless flexible knife blade is supported by a pair of similar rollers respectively mounted adjacent opposite sides of a traveling conveyor of predetermined width, said knife being supported by said rollers to dispose one section of the knife, usually the lower section, at a predetermined level above the upper surface of the conveyor which is utilized to feed successive rows of rolls to said knife to be sliced thereby. One problem encountered in successfully slicing the rolls with a band knife of this type is that the roll must be held in reasonably firm contact with the conveyor to insure that the roll passes to and beyond the section of the endless knife which slices it. Such pressure is accomplished at the present in various ways, such as by narrow, horizontal belts or equivalent means which tend to exert relatively uniform pressure across the entire upper surface of the rolls.

When substantially uniform pressure is applied to the upper surface of rolls being sliced, for example, by an endless band type blade, there is no means provided to compensate for rolls of uneven thickness. For example, when hamburg type rolls are baked, they sometimes are relatively thin along one side and much thicker along the opposite side. If some type of pressure means is utilized to engage substantially the overall upper surface of rolls to maintain the same in frictional contact with the feeding conveyor of the machine in order to insure movement of the rolls to and past the operative section of the endless band type knife blade, when a roll of uneven thickness, such as a so-called "lopsided" roll is engaged by such pressure means, it will compress the upper surface of the roll so as to be substantially parallel to the bottom surface thereof but, after the roll is sliced, the product which emerges beyond the knife section will comprise top and bottom sections which are both of uneven thickness and therefore are lopsided. This is unacceptable to establishments of the type referred to above which now dispense millions of hamburger-like products of many different types each day at present and these establishments insist upon the sliced lower portion of each roll being of uniform thickness throughout and not lopsided.

SUMMARY OF THE INVENTION

One of the principal objects of the present invention is to provide in a band type roll slicing machine yieldable pressure means mounted above the section of the knife which executes the slicing of rolls entirely through the complete length and width thereof in order that the pressure means will hold the bottom of the rolls flatly against the feed conveyor of the machine and any uneveness in the upper surface of the roll is compensated for by the yieldability of the pressure means, whereby no portion of the roll is subjected to abnormal localized pressure in order that the bottom section of the roll, after being sliced from the upper section, will be of substantially uniform thickness throughout the area of said bottom section.

Ancillary to the foregoing object, it is another object of the invention to provide said yieldable pressure means in the form of a series of rollers which are congregated relatively closely to each other in both longitudinal and transverse directions with respect to the path of movement of the rolls which are being sliced by the machine in order that the upper surfaces of the rolls may be engaged simultaneously by a plurality of surface portions of said pressure rollers so as to provide effective, substantially overall pressure upon the upper surfaces of the rolls, more or less commensurate with the contour of said upper surfaces in order that no localized, abnormal pressure will be applied against said upper surfaces of the rolls.

A still further object of the invention related to the foregoing objects is to provide a transverse frame extending between opposite sides of the feed conveyor of the machine, said frame supporting a plurality of rows of rollers respectively rotatable upon a plurality of axes extending transversely between opposite sides of the machine, said axes being transversely spaced from each other distances less then the diameters of the rollers supported upon said axes and the rollers in adjacent rows being staggered relative to each other so as to intermesh the overall group of rollers to provide the closely related surface contact points of the rollers upon individual rolls in the manner described above, at least the major number of said rollers being yieldably supported upon said transverse frame.

Still another object of the invention related to the foregoing objects is to provide a plurality of sets of bracket arms movably connected at one end to said transverse frame and said sets respectively being of different lengths and alternate brackets of said two sets being arranged in alternate fashion in order that the rollers supported by the opposite ends of said bracket arms will be alternately staggered with respect to each other and the staggered axes of said rollers, when at rest, being respectively in axial alignment with each other to comprise a pair of parallel axes for the rollers supported upon said axes, thereby contributing to the compactness of the roller arrangements to effect said plurality of peripheral contacts, simultaneously, of said rollers with individual rolls passing beneath said rollers.

Another object of the invention is to provide, preferably, three rows of rollers and the section of the endless band type knife which performs the slicing of the rolls being disposed vertically below the axis of the central row of rollers, thereby assuring a balanced type of positioning of the rolls upon the feed conveyor incident to the same being sliced by said section of the knife, as well as affording means to maintain the sliced-apart top and bottom sections of the rolls in vertical contiguous relationship after the completion of the slicing of the roll.

One further object of the invention also is to utilize rollers which are relatively narrow and the axial spacing of said rollers between each other upon individual axes of the plurality of rows thereof contributing to the relatively close nesting of the rollers of the various rows thereof with respect to each other and, in the preferred construction of said rollers, the central periphery thereof is provided with a narrow ridge extending around the rollers to provide limited contact of the peripheries of said rollers with the upper surfaces of rolls being sliced, said central ridge means being formed of frictional material which operates to insure rotation of the rollers along the upper surfaces of the rolls being sliced.

Details of the foregoing objects and of the invention, as well as other objects thereof, are set forth in the following specification and illustrated in the accompanying drawings comprising a part thereof.

DETAILED DESCRIPTION

Figure 1:
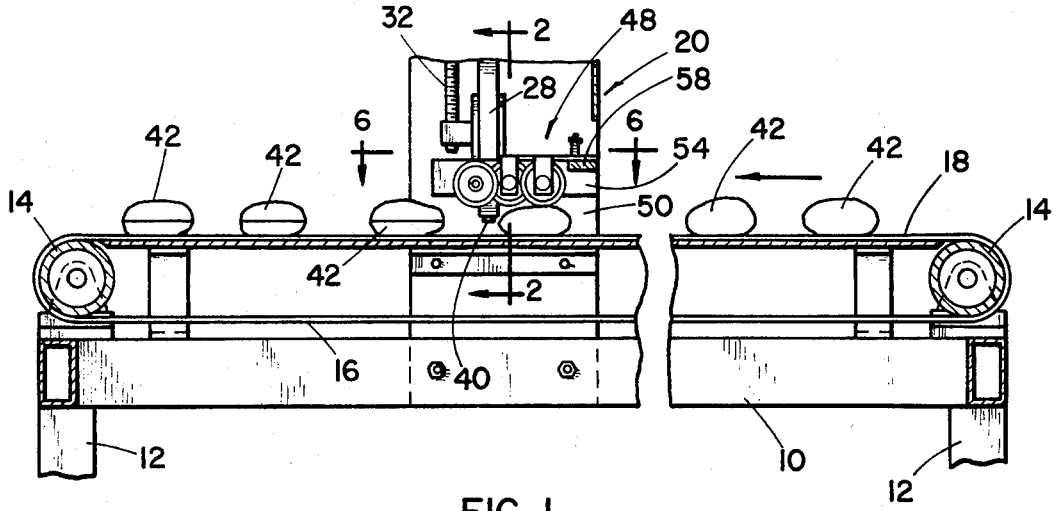
FIG. 1 is a fragmentary, foreshortened side elevation of those portions of a substantially conventional type of band knife roll slicing machine in which yieldable pressure means comprising one of the principal objects of the present invention is illustrated.

Referring to FIG. 1, there is illustrated, fragmentarily therein, a horizontal frame 10 of a band type roll slicing machine, said frame being supported by suitable legs 12 or by any other conventional means. As indicated above, said view has been foreshortened longitudinally to accommodate the same to the drawing. Adjacent opposite ends of the frame 10, a pair of freely rotatable rolls 14 are supported by conventional means and an endless, flexible feed conveyor 16 of conventional construction and material extends around said roller 14. Appropriate drive means, not shown, such as an electric motor, is connected by suitable chain or belt means to one of the rolls 14 for purposes of moving the upper span 18 of the conveyor 16 in feeding direction as indicated by the arrow above the same in FIG. 1.

Figure 2:
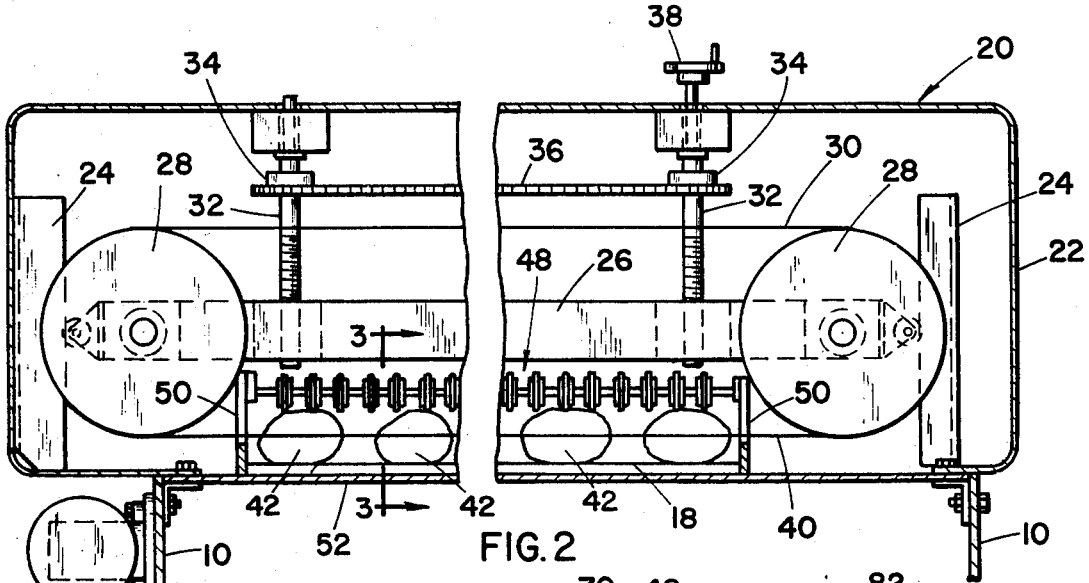
FIG. 2 is a fragmentary, transversely foreshortened view of a portion of the machine shown in FIG. 1 as seen on the line 2—2 thereof, FIG. 2 being illustrated on a substantially larger scale than FIG. 1.

Supported intermediately of opposite ends of the frame 10 is a transverse frame 20, the rudiments of which are shown in FIG. 2. In addition to the frame 20 comprising a housing 22, a pair of vertical guides 24 are supported in opposite ends of housing 22 for purposes of being engaged by the opposite ends of a knife supporting sub-frame 26 opposite end portions of which support a pair of similiar drums 28 around which an endless knife 30 extends. As desired, one or both of the opposite edges of the endless knife band 30 may be sharpened. The sub-frame 26 also is vertically adjustable by means of a pair of rotatable screws 32, the lower ends of which are threaded appropriately in blocks mounted within the sub-frame 26 and the screws 32 are driven simultaneously in the same rotary directions by means of sprocket gears 34 which are respectively fixed to the screws 32 and around which a sprocket chain 36 extends. One of the screws 32 has a hand wheel or crank 38 connected thereto for operation of the screws 32 and it will be understood that the upper ends of the screws 32 are suitably anchored by conventional means against vertical movement with respect to the housing 22. Rotation of the screws in opposite directions will raise or lower the lower section 40 of the endless knife 30 toward or from the upper span 18 of the feed belt 16 in order to effect slicing of the rolls 42 at a desired vertical level thereof, such as illustrated in exemplary manner in FIG. 3, primarily to effect a lower roll section 44 of uniform thickness throughout the entire area thereof.

One of the drums 28 is rotated at desired speed by power means such as another electric motor 46 which is shown in exemplary manner in FIG. 2 and the same is connected for example to the left hand drum 28 shown in that figure by any appropriate mechanical means, none of which are shown in detail, and said means may also include speed regulating mechanism of a conventional nature, if desired. Also, exemplary means are illustrated in FIG. 2 by which the housing 22 of the transverse frame 20 is connected to the horizontal frame 10 to support the same but it is to be understood that such illustration is primarily for exemplary purposes.

YIELDABLE PRESSURE MECHANISM

As referred to above, one of the major and important objectives of the present invention is to provide yieldable pressure means engageable with the upper surfaces of the rolls 42 as the same are moved while engaging the feed conveyor 16, 18 into contact with the leading edge of the section 40 of the endless flexible knife 30 which serves the rolls between the upper and lower surfaces thereof. The pressure means provided by the present invention has been designed particularly to insure that the lower roll section 44 of the rolls 42, after being completely sliced by the knife section 40, will be of substantially uniform thickness throughout the entire area of said lower sections. This is achieved by the yieldable nature of said pressure means, details of which are as follows.

Details of the yieldable pressure means of the present invention are best illustrated in enlarged scale in FIGS. 3–7 but attention is directed to FIG. 1 in particular to illustrate the preferred location of said pressure means, wherein it will be seen that said pressure means 48 is located above the upper span 18 of the feed conveyor 16, the same also being above the lower section 40 of the endless knife 30. Pressure means 48 comprises a frame which includes side members 50 which extend upward from horizontal means 52, see FIG. 2, of the frame 10 of the machine, respectively adjacent opposite side edges of the upper span 18 of feed conveyor 16. Mounted along the inner surfaces of the side members 50 adjacent the upper edges thereof are similar horizontal plates 54 between which one fixed horizontal shaft 56 extend. A transverse support plate 58 also extends between and is connected at its opposite ends to the horizontal plates 54 for purposes described hereinafter.

The essential beneficial characteristics of the present invention comprises the yieldable mounting of at least some or, preferably, the majority of a plurality of similar rollers 60 which are embodied in the pressure unit or assembly 48, the rollers 60 also preferably are all similar and one particular type which has been found to be highly satisfactory and readily available comprises skate wheels which are formed from durable plastic or synthetic resin and are provided with central sleeves 62 comprising part of an anti-friction bearing unit in each of said wheels, whereby said wheels present no appreciable rolling friction. In the preferred construction of each roller 60 which is utilized to adapt the same to the present invention, the skate wheels comprising said rollers are formed with a central groove within which an O-ring 64 is mounted, said O-rings being of a frictional nature and also having limited elasticity to maintain the same mounted within the grooves formed within the periphery of the rollers 60, thereby providing said rollers with a central annular rib which provides frictional engagement between the upper surfaces of the rolls 42 and the rollers 60 to insure anti-friction rotation thereof and eliminate and possibility of causing drag to be exerted upon the upper surfaces of said rolls by said rollers.

Figure 3:
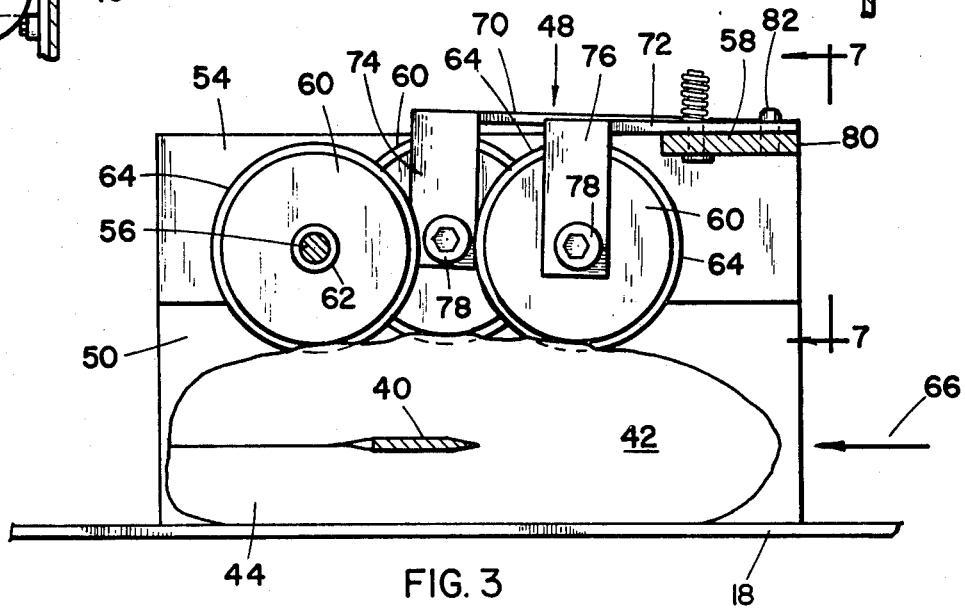
FIG. 3 is a fragmentary vertical sectional view, shown on a further enlarged scale than utilized in FIG. 2 and showing details of the yieldable pressure means of the present invention as seen substantially on the line 3—3 of FIG. 2.

Attention is directed to FIG. 3 in which the direction of movement of the feed belt and the rolls 42 is indicated by a direction arrow 66. From this view as well as from FIGS. 5 and 6, it will be seen that the preferred embodiment of the invention comprises three rows of rollers 60, said rollers being supported upon parallel axes, the distance between successive axes thereof being less than the diameter of the rollers 60 as clearly evidenced in FIGS. 3 and 5. Also, as best seen in FIG. 6, the rollers 60 mounted upon the preferably stationary shaft 56 are separated by short spacing sleeves 68, the length of said sleeves being such as to provide suitable spaces between successive rollers 60 on shaft 56 to accommodate the rollers 60 of a second, intermediate row of such rollers 60 which are supported by a set of bracket arms 70 which are longer than a second set of bracket arms 72. Each of the bracket arms 70 and 72 respectively have depending bracket legs 74 and 76 which, at the lower ends thereof, have short shafts 78 fixed thereto and upon which the central sleeves 62 of the anti-friction bearings of the rollers 60 are mounted fixedly.

Transverse support plate 58, along the leading edge 80 thereof, see FIG. 3, is provided with a series of similar short pins 82 which are evenly spaced longitudinally along the support plate 58. One end of each of the bracket arms 70 and 72 are provided with similar holes slightly larger in diameter than the pins 82 for purposes of receiving the same to position said ends of said bracket arms for very limited movement of the opposite ends of said bracket arms in a vertical direction to permit yieldability of the rollers 60 supported upon said arms when the same engage the upper surfaces of the rolls 42.

Limited vertical movement of the axes of the arms 70 and 72 is afforded by means of additional short shafts 84, at least the upper ends of which are threaded, and the opposite ends thereof are fixed to the transverse support plate 58 in spaced relationship to the short pins 82 thereon. The bracket arms 70 and 72 also are provided with a second hole of slightly larger diameter than the shafts 84, said shafts extending through said hole and said shafts 84 also having compression springs 86 surrounding the same. The lower ends of said springs engage the upper surfaces of the bracket arms 70 and 72 and the threaded upper ends of the shafts 84 accommodate pressure-adjusting nuts 88. Preferably, the springs 86 are selected as to length and strength to provide only limited pressure upon the horizontal portions of the bracket arms 70 and 72 so that the same comprise levers of the second class, the fulcrum of said levers comprising the ends thereof which receive the short pins 82.

Due to the fact that all of the bracket arms 70 are of the same length and all of the bracket arms 72 are of the same length but of a lesser length than the arms 70, it will be seen particularly from FIG. 6 that the axes of all of the rollers 60 which are on the shorter bracket arm 72, when it rests relative to the support plate 58, are coaxial and comprise an axis which is spaced transversely to the axis of fixed shaft 56. Similarly, the axes of all of the rollers 60 which are supported by the longer bracket arms 60, when in rest position upon support plate 58, will be coaxial and comprise an intermediate axis between the axis of fixed shaft 56 and the axis formed by the rollers on the shorter bracket arms 72 when at rest. As best shown in FIG. 3, these three axes, which are all parallel to each other when the rollers are all at rest, are positioned with respect to the lower section 40 of the endless knife 30 so that said section 40 of the knife is substantially vertically below the intermediate axis comprising the coaxial axes of the rollers 60 supported by the longer bracket arms 70. From FIG. 6, it also will be seen that in the preferred construction of the yieldable pressure means of the present invention, the rollers 60 which are supported by the shorter bracket arms 72 are in alignment with the rollers 60 on the preferably fixed shaft 56 considered in the direction of the movement of the feed belt which is in the direction of the direction arrow 90 shown in FIG. 6 and from FIG. 6 it also will be seen that the bracket arms 70 and 72 all extend in the same direction from the support plate 58, toward the shaft 56.

Figure 4:
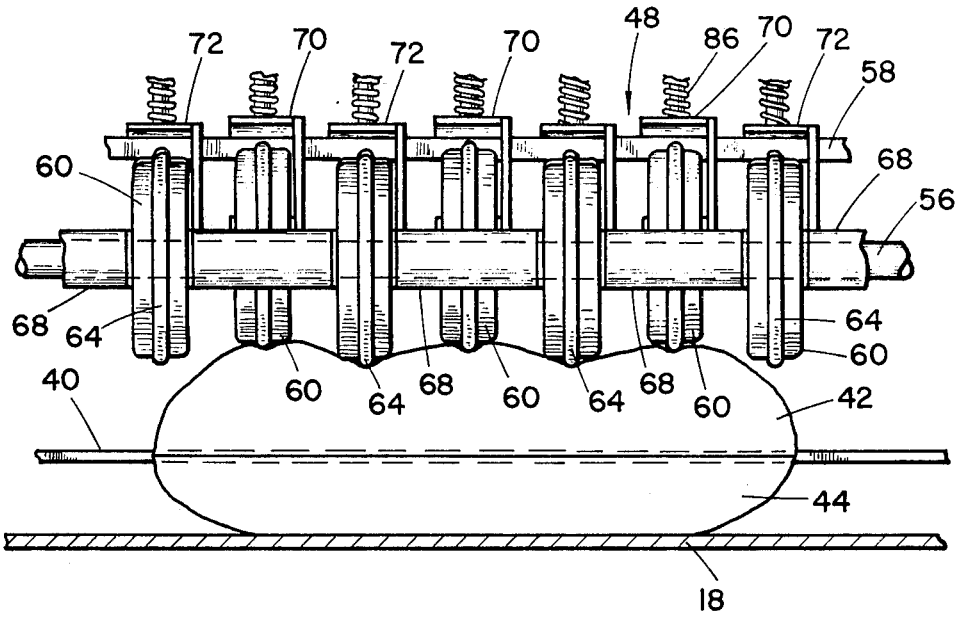
FIG. 4 is a fragmentary view similar to FIG. 3 but illustrated at a right angle to the view shown in FIG. 3.

In FIG. 4, the roll 42 is shown in exemplary proportion with respect to the size and axial arrangement of the various pressure-applying rollers 60 including those supported respectively by the bracket arms 70 and 72 as well as those supported by the shafts 56 for purposes of illustrating the simultaneous engagement of peripheral portions of a plurality of the rollers 60 with the upper surface of the roll 42 and thus illustrate the manner in which the pressure means comprising the rollers 60 of the present invention afford an overall, yieldable pressure-exerting means which, with only relatively light pressure, conforms itself to the contour of the upper surface of the rolls 42 in a manner which will not unduly compress or deform said upper surface but which nevertheless effectively holds the bottom surface of the roll 42 against the feed conveyor 18 and because no undue or excessive amount of pressure is flatly upon the upper surfaces of said rolls 42, the invention insures that the lower section 44 of each roll, when sliced by the section 40 of the knife, will be of substantially uniform thickness throughout the entire area of said lower section 44.

Not only will the arrangement of the yieldable pressure rollers 60, in transverse disposition to the rolls, provide a plurality of pressure contacts with the upper surface of the rolls 42 but, as viewed particularly in FIG. 3, it will be seen that in a longitudinal direction, there is a simultaneous contact of a plurality of the various sets of rollers upon the various axes thereof to further achieve the generally overall engagement of the upper surfaces of the rolls 42 by said pressure exerting rollers 60, such engagement however being of a relatively light nature so as to not unduly crack or deform the upper surfaces of the rolls 42 and in this regard, the provision of the central annular ribs afforded by the O-rings 64 further insures relatively light contact between the rollers 60 and the upper surfaces of the rolls 42.

Figure 5:
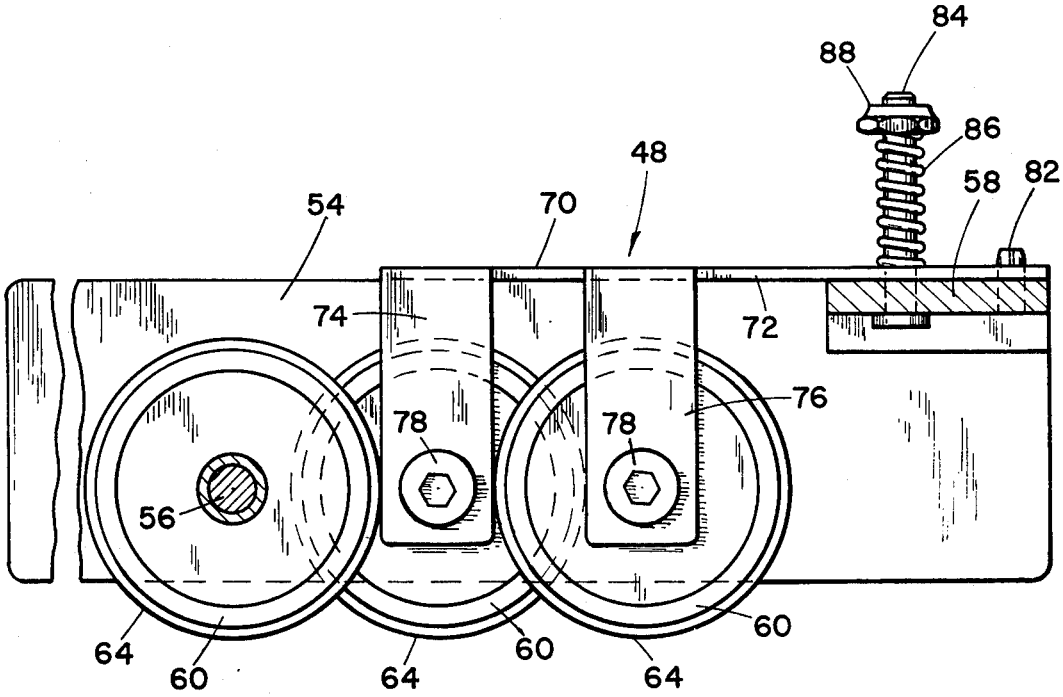
FIG. 5 is a fragmentary vertical end view, partly foreshortened, of the yieldable pressure means as seen along the line 5—5 of FIG. 6 and showing further details of said pressure means of the invention.
Figure 6:
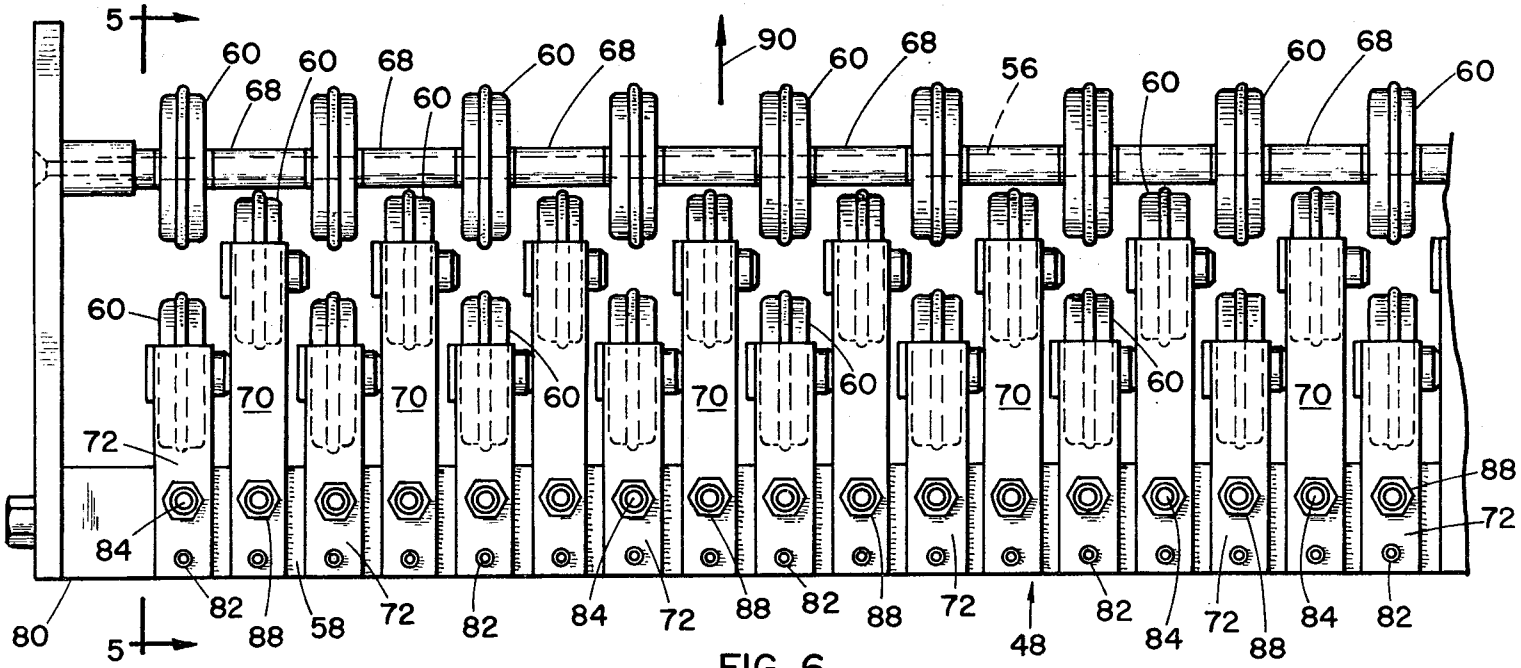
FIG. 6 is a fragmentary plan view of the overall yieldable pressure means of the present invention substantially as seen along the lines 6—6 of FIG. 1 and illustrated on a very much larger scale than FIG. 1.
Figure 7:
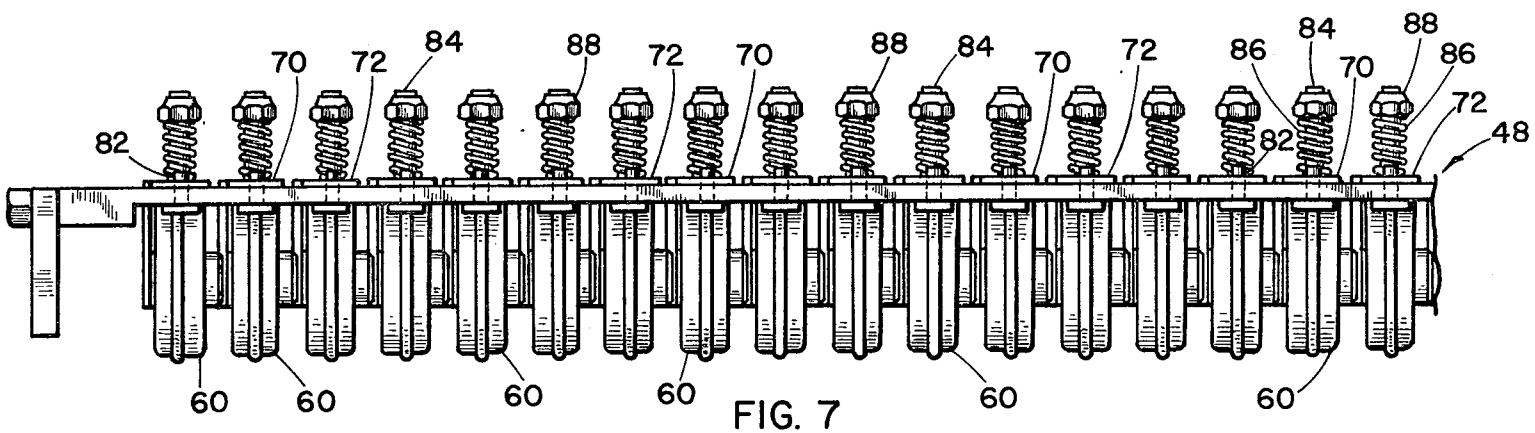
FIG. 7 is a front elevation of the yieldable pressure means illustrated in FIG. 6, as seen along the line 7—7 of FIG. 3.

As readily shown in FIGS. 3, 4 and 6, there also is a nested or intermeshed relationship of the various rows of rollers 60 which can be best appreciated from FIGS. 3 and 5, considered sidewise, and from FIG. 6 when considered in a direction transverse to the path of movement of the rolls 42.

It can be appreciated from FIG. 3 that, due to the slicing section 40 of the band type knife 30 being mounted for operation substantially vertically below the central axis of the three axes presented respectively by the three rows of rollers 60, pressure will be exerted upon the upper surface of the rolls 42 to a limited extent even after the knife section 40 has effected a complete slicing through each of the rolls and this feature, afforded by the construction of the pressure means of the present invention, serves to maintain the sliced upper and lower or top and bottom parts or portions of the sliced rolls being maintained in vertical alignment with each other to facilitate packaging and further handling thereof incident to merchandizing the sliced rolls. As also can be further appreciated from FIG. 3, initial engagement of the roll occurs by the rollers 60 supported by the shorter bracket arms 72 and such engagement is of a yieldable nature, as is also the further and subsequent engagement of the roll 42 by the intermediate row of rollers 60 which are supported by the longer bracket arms 70. In view of this, even though rolls may be of a rather appreciable lopsided nature, the yieldable nature of the rollers 60 supported by the bracket arm 70 and 72 will cause the same to generally conform to such contour without undue squeezing or squashing of the rolls 42 and thereby insure the uniform thickness of the lower or bottom section 44 of the roll, not withstanding the fact that the trailing row of rollers 60 which are supported upon the fixed shaft 56 affords no yieldability. By the time the partially sliced rolls reach a location where the upper surfaces are engaged only by rollers 60 on fixed shaft 56, the slicing has been accomplished and thereby the fixed nature of the shaft 56 will not detract from the objective of the invention with respect to the uniform thickness of the bottom section 44 of the sliced roll.

Although the description set forth above has been directed specifically to a roll slicing machine and system in which there is only a single slicing band, it is to be understood that the basic principles of the machine may be applied and utilized to equal advantage with machines in which multiple band knives are mounted such as those employed to slice rolls at two levels such as those used to make so-called double decker sandwiches.

The foregoing description illustrates preferred embodiments of the invention. However, the concepts employed may, based upon such description, be employed in other embodiments without departing from the scope of the invention. Accordingly, the following claims are intended to protect the invention broadly, as well as in the specific forms shown herein.

I claim:

1. A band type roll slicing machine comprising a substantially horizontal endless conveyor supported for movement in a direction to support and feed a plurality of rolls simultaneously in a predetermined direction, an endless band type knife supported adjacent said conveyor and one section of said knife being disposed transversely and parallel to said conveyor in spaced relationship above the upper surface thereof a predetermined distance between the top and bottom surfaces of rolls to be sliced thereby, and power means to drive said conveyor and knife in operative directions; in combination with pressure means mounted above and substantially in vertical alignment with said section of said knife and supported for limited yieldable movement away from said conveyor, means engaging said pressure means and exerting relatively light pressure thereon toward said conveyor, said pressure means comprising a series of relatively narrow rollers operable upon axes extending transversely to the direction of movement of said conveyor and spaced apart axially relatively short distances to form a nested arrangement of said rollers to permit a plurality of said rollers simultaneously to engage the upper surfaces of rolls upon said conveyor in locations both transverse and longitudinal to and extending substantially in parallel relationship to the path of movement of said conveyor, and friction means on the peripheries of said rollers engaging the upper surfaces of said rolls with light pressure as carried by said conveyor into contact with said section of said knife to minimize lateral movement of said rolls from said path of movement thereof while being sliced and also hold said rolls in frictional engagement with said conveyor without unduly compressing or deforming the upper surfaces of rolls and thereby also maintain the upper and lower portions of rolls in superimposed vertical relationship when the same have the slicing thereof into said upper and lower portions completed.

2. The machine according to claim 1 in which said yieldable pressure rollers are anti-friction in nature relative to the support means therefor.

3. The machine according to claim 1 in which said rollers are mounted in multiple groups and the rollers of said groups respectively are intermeshed with respect to each other a limited extent in the direction of the path of movement of said rolls by said conveyor.

4. The machine according to claim 3 in which at least certain of said rollers in said group are supported by means exerting individual yieldable limited pressure respectively upon said rollers.

5. The machine according to claim 1 in which said yieldable pressure means comprise a frame member extending transversely across said conveyor in parallel relation to and above said section of said knife and substantially in vertical alignment therewith, means upon said frame member supporting a plurality of rows of rollers on axes in vertical planes spaced transversely apart relative to the direction of movement of said conveyor, the rollers in each row being spaced axially apart distances upon said means no greater than the diameter of said rolls being sliced by said machine and said section of said knife being positioned for movement in a vertical plane between the planes of the axes of said rows of rollers.

6. The machine according to claim 5 in which the rollers in adjacent rows thereof are staggered relative to each other to provide limited intermeshing of said rollers in said rows with each other to provide a relatively concentrated plurality of surface portions of said rollers for simultaneous engagement with individual rolls passing beneath said rollers for engagement by said section of said knife for slicing of said rolls transversely through the entire area thereof.

7. The machine according to claim 5 in which adjacent axes of said rows of rollers are spaced apart a distance less than the diameter of said rollers, thereby providing limited intermeshing of the rollers of successive rows thereof.

8. The machine according to claim 7 in which said rollers are all of substantially uniform diameter.

9. The machine according to claim 5 in which the rollers of at least one row are mounted by yieldable means permitting a limited vertical movement of said rollers incident to engaging the upper surfaces of rolls while said rolls are being sliced by said section of said knife.

10. The machine according to claim 9 in which said frame is provided with one stationary support member extending between opposite edges of said conveyor above the same, and a plurality of bracket arms connected yieldably to said stationary support member, said bracket arms respectively supporting rollers thereon in freely rotatable manner.

11. The machine according to claim 10 in which two sets of said bracket arms respectively of different lengths and arranged alternatively with respect to each other are supported by said stationary support member, one end of each bracket arm being connected to said stationary support member for limited vertical movement of the rollers respectively supported by said bracket arms, all of said bracket arms extending in the same direction from said stationary support members, and said rollers respectively being connected to the opposite ends of said bracket arms and the different lengths of said alternately arranged bracket arms forming two rows of said rollers respectively having substantially common axes.

12. The machine according to claim 11 further including springs respectively engaging said bracket arms lightly and urging the same downward to dispose the rollers supported by said bracket arms at a predetermined low level adequate to insure engagement of said rollers with the upper surfaces of rolls when moved beneath said rollers by said conveyor for slicing by said knife section.

13. The machine according to claim 5 in which three rows of said rollers are supported by said frame member and said knife section being positioned for operation vertically below the center row of rollers.

14. The machine according to claim 13 in which the rollers of said central and leading row thereof are supported by means permitting limited vertical yielding movement of said rollers and said trailing row of rollers being supported upon a fixed axis disposed in a vertical plane rearward of the vertical plane in which said knife section operates.

15. The machine according to claim 5 in which said friction means upon said rollers comprise relatively narrow central ridge means to minimize the surface engagement of said rollers with the upper surfaces of rolls contacted thereby incident to being sliced and also facilitate said minimizing of lateral movement of said rolls from said path of movement thereof.

16. The machine according to claim 15 in which said central ridge means upon said rollers are formed of frictional material operable to effect rotation of said rollers incident to the same engaging the upper surfaces of rolls carried beneath said rollers by said conveyor.

* * * * *